US009189913B2

(12) United States Patent
Chen et al.

(10) Patent No.: US 9,189,913 B2
(45) Date of Patent: Nov. 17, 2015

(54) AUTOMATIC VENDING MACHINE

(71) Applicants: HONG FU JIN PRECISION INDUSTRY (WuHan) CO., LTD., Wuhan (CN); HON HAI PRECISION INDUSTRY CO., LTD., New Taipei (TW)

(72) Inventors: Yun-Lung Chen, New Taipei (TW); Jiang-Feng Jiao, Wuhan (CN); Yu-Ming Xiao, Wuhan (CN)

(73) Assignees: HONG FU JIN PRECISION INDUSTRY (WuHan) CO., LTD., Wuhan (CN); HON HAI PRECISION INDUSTRY CO., LTD., New Taipei (TW)

( * ) Notice: Subject to any disclaimer, the term of this patent is extended or adjusted under 35 U.S.C. 154(b) by 94 days.

(21) Appl. No.: 14/011,922

(22) Filed: Aug. 28, 2013

(65) Prior Publication Data

US 2014/0190985 A1 Jul. 10, 2014

(30) Foreign Application Priority Data

Jan. 8, 2013 (CN) ..... 2013 1 0005330

(51) Int. Cl.
*G07F 11/00* (2006.01)
*G07F 11/42* (2006.01)
*G07F 11/36* (2006.01)

(52) U.S. Cl.
CPC ..... *G07F 11/42* (2013.01); *G07F 11/36* (2013.01)

(58) Field of Classification Search
CPC ..... G07F 11/36
USPC ..... 221/1, 258, 75, 48, 59.3, 71, 277; 206/531, 538, 534; 279/140
See application file for complete search history.

(56) References Cited

U.S. PATENT DOCUMENTS

| | | | | | |
|---|---|---|---|---|---|
| 2,623,641 | A * | 12/1952 | Shield | 211/59.2 |
| 3,178,055 | A * | 4/1965 | Schuller | 221/75 |
| 3,344,953 | A * | 10/1967 | Krakauer et al. | 221/75 |
| 3,883,039 | A * | 5/1975 | Wittern et al. | 221/75 |
| 3,929,255 | A * | 12/1975 | Wittern et al. | 221/75 |
| 3,986,637 | A * | 10/1976 | Wittern et al. | 221/75 |
| 4,600,119 | A * | 7/1986 | Olson | 221/75 |
| 4,744,490 | A * | 5/1988 | Albright et al. | 221/75 |
| 4,757,915 | A * | 7/1988 | Albright et al. | 221/75 |
| 7,066,348 | B2 * | 6/2006 | Skavnak | 221/75 |
| 8,025,181 | B1 * | 9/2011 | Horn et al. | 221/226 |
| 8,190,289 | B2 * | 5/2012 | Lockwood et al. | 700/236 |
| 8,684,227 | B2 * | 4/2014 | Richardson et al. | 221/251 |
| 2014/0061229 | A1 * | 3/2014 | Chen et al. | 221/277 |
| 2014/0190985 | A1 * | 7/2014 | Chen et al. | 221/277 |

* cited by examiner

*Primary Examiner* — Rakesh Kumar
(74) *Attorney, Agent, or Firm* — Novak Druce Connolly Bove + Quigg LLP

(57) ABSTRACT

An automatic vending machine with a stabilizing support for stocked items of merchandise includes a cabinet, a driving member secured in the cabinet, a helical element, and a pressing member secured to the cabinet. The cabinet includes a bottom plate. The helical element is secured to the driving member and moveable by the driving member. The pressing member is located within the coils of the helical element and runs the length of the helical element to support items of merchandise and reliably deliver an item of merchandise when bought.

17 Claims, 3 Drawing Sheets

AUTOMATIC VENDING MACHINE

BACKGROUND

1. Technical Field

The present disclosure relates to automatic vending machines.

2. Description of Related Art

Automatic vending machines allow customers to buy merchandise twenty four hours a day. When the customer retrieves the merchandise from the automatic vending machine, a helical element in a cabinet is rotated to push the merchandise out of the cabinet. However, a free end of the helical element may be warped or otherwise act to snag or catch on the merchandise, preventing delivery of the merchandise out of the cabinet. Therefore, there is room for improvement within the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
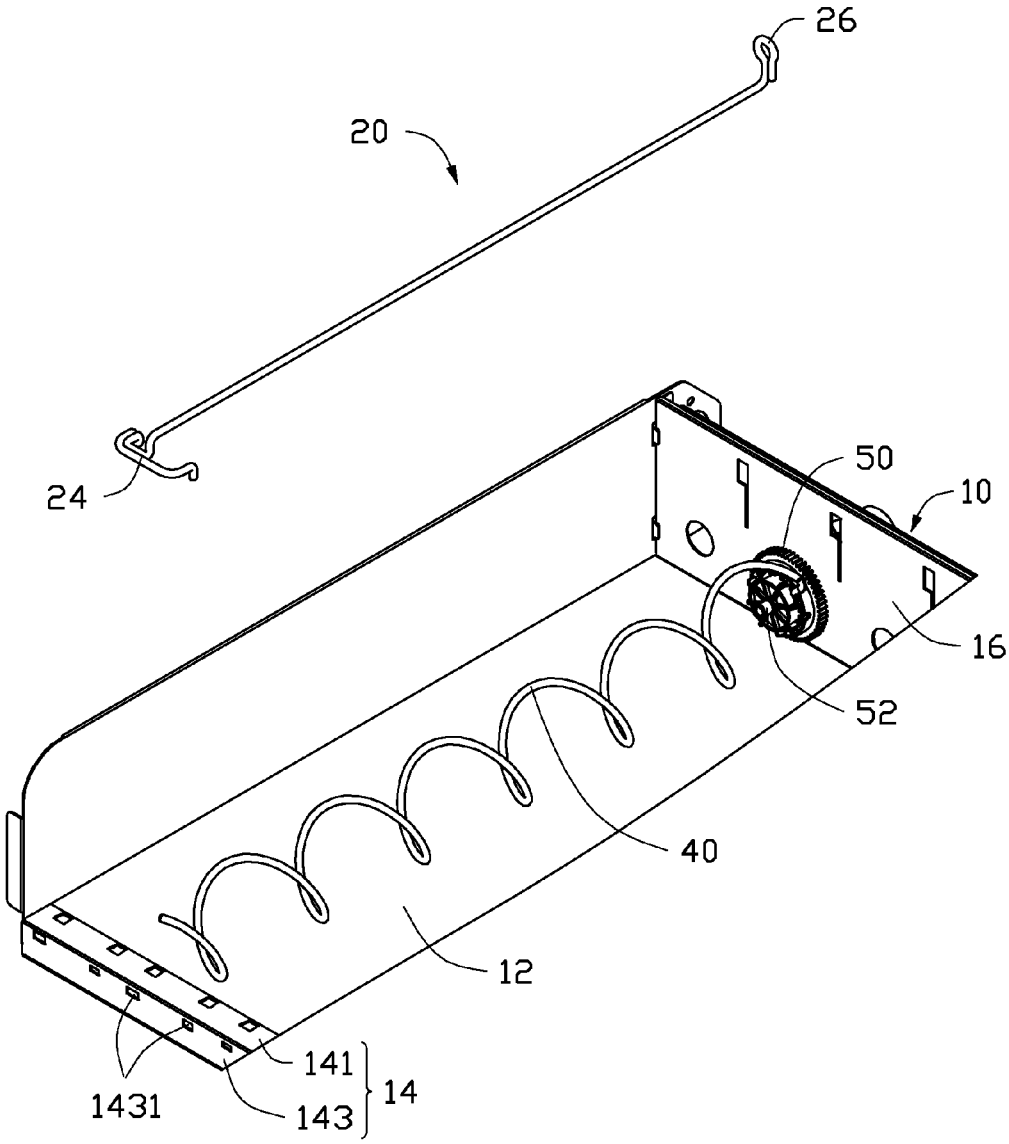
FIG. 1 is an exploded, isometric view of an automatic vending machine in accordance with an embodiment.
Figure 2:
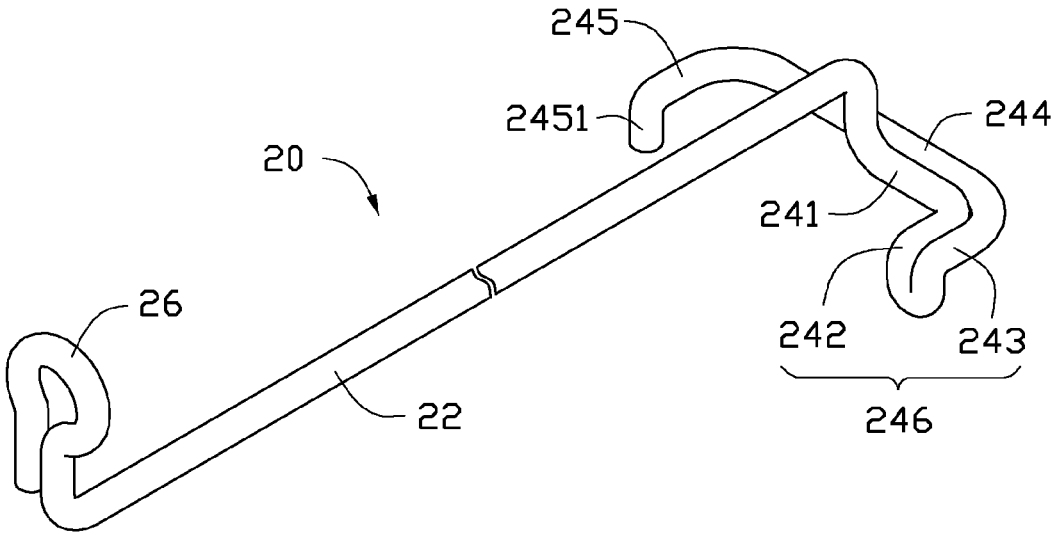
FIG. 2 is an isometric view of a pressing member of the automatic vending machine of FIG. 1.

FIGS. 1 and 2 illustrate an automatic vending machine in accordance with an embodiment. The automatic vending machine comprises a cabinet 10, a pressing member 20, a helical element 40, and a driving member 50. For example, the driving member 50 may be a motor.

The cabinet 10 comprises a bottom plate 12, a mounting portion 14 extending from the bottom plate 12, and a rear plate 16 extending from the bottom plate 12. In one embodiment, the mounting portion 14 is substantially L-shaped, and the rear plate 16 is substantially perpendicular to the bottom plate 12. The driving member 50 is secured to the rear plate 16, and the driving member 50 comprises a rotating shaft 52. A first end of the helical element 40 is secured to the rotating shaft 52, so that the helical element 40 can be rotated by the driving member 50. A second end of the helical element 40 is located above the mounting portion 14.

The mounting portion 14 comprises a first flange 141 and a second flange 143 substantially perpendicular to the first flange 141. The first flange 141 and the bottom plate 12 are located on a same plane. A plurality of securing holes 1431 is defined in the second flange 143.

The pressing member 20 comprises a main post 22, a first securing portion 24 extending from a first end of the main post 22, and a second securing portion 26 extending from a second opposite end of the main post 22.

The first securing portion 24 comprises a first extending post 241, a second extending post 242, a third extending post 243, a fourth extending post 244, and a fifth extending post 245. The first extending post 241 extends downward relative to the main post 22. The second extending post 242 substantially perpendicular extends from first extending post 241. The third extending post 243 extends from the second extending post 242 and abuts the second extending post 242, so that the second extending post 242 and the third extending post 243 together define a first clipping portion 246. The fourth extending post 244 substantially perpendicular extends from third extending post 243. The fifth extending post 245 extends substantially perpendicular <fix all> from fourth extending post 241 and is substantially parallel to the third extending post 243. A second clipping portion 2451 extends downward from the fifth extending post 245.

The second securing portion 26 extends upward from the main post 22 and is hung on the rotating shaft 52. In one embodiment, a length of the main post 22 is substantially equal to a length between the rear plate 16 and the first flange 141, that is, the main post 22 is substantially as long as long as the helical element 40.

Figure 3:
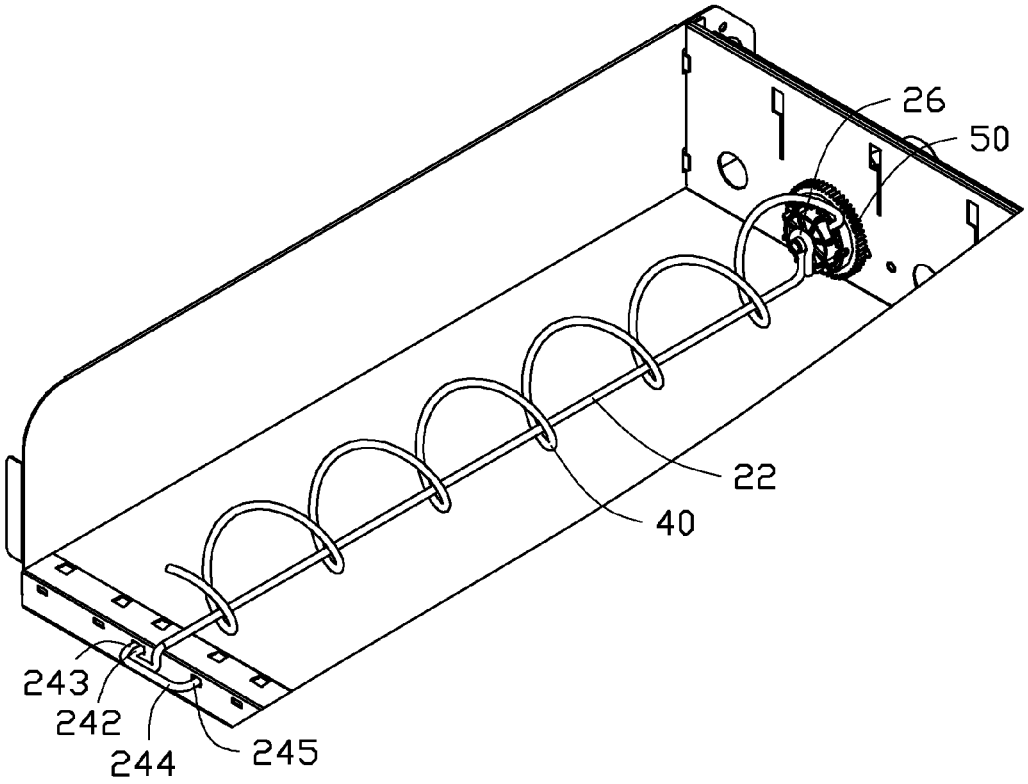
FIG. 3 is an assembled view of the automatic vending machine of FIG. 1.

FIGS. 3-4 illustrate assembly of the automatic vending machine in accordance with an embodiment. In assembly, the pressing member 20 extends into the interior of the helical element 40, and the second securing portion 26 is clipped with the rotating shaft 52. The first clipping portion 246 and the second clipping portion 2451 are engaged in two of the plurality of securing holes 1431, so that the pressing member 20 is secured to the cabinet 10. The main post 22 is substantially parallel to the bottom plate 12 and bears down on the helical element 40, for preventing helical element 40 from becoming warped.

When the helical element 40 is rotated, the helical element 40 is rotated outside the pressing member 20, and the pressing member 20 does not prevent the free rotation of the helical element 40. Items of merchandise are thus supported along the length of the pressing member 20, and the presence of the pressing member 20 under the merchandise acts to stabilize the items of merchandise when being moved.

It is to be understood, however, that even though numerous characteristics and advantages have been set forth in the foregoing description of embodiments, together with details of the structures and functions of the embodiments, the disclosure is illustrative only and changes may be made in detail, especially in the matters of shape, size, and arrangement of parts within the principles of the disclosure to the full extent indicated by the broad general meaning of the terms in which the appended claims are expressed.

What is claimed is:

1. An automatic vending machine comprising:

a cabinet comprising a bottom plate and a mounting portion; the mounting portion defining two securing holes;

a driving member secured to the cabinet;

a helical element secured to the driving member and being moveable when driven by the driving member; and a pressing member secured to the cabinet and comprising a first securing portion and a second securing portion engaged with the two securing holes; the second securing portion comprising a first extending post, a second extending post extending from the first extending post, and a third extending post extending from the second extending post; the third extending post abutting the second extending post; and a first clipping portion being defined by the second extending post and the third extending post;

wherein the pressing member is located in an interior of the helical element and extends through the helical element from a helical element first end to a helical element second end.

2. The automatic vending machine of claim 1, wherein the helical element is rotatable about the pressing member.

3. The automatic vending machine of claim 1, wherein the pressing member further comprises a main post, the first securing portion extends from a main post first end, and the second securing portion extends from a main post second end; and the first securing portion is secured to the driving member, and the second securing portion is secured to the cabinet.

4. The automatic vending machine of claim 3, wherein the driving member comprises a rotating shaft, and the first securing portion is secured to the rotating shaft.

5. The automatic vending machine of claim 3, wherein the mounting portion is connected to the bottom plate and opposite to the driving member, and the second securing portion is secured to the mounting portion.

6. The automatic vending machine of claim 5, wherein the mounting portion comprises a first flange substantially parallel to the bottom plate and a second flange substantially perpendicular to the first flange; and the two securing holes are defined in the second flange.

7. The automatic vending machine of claim 1, wherein the second securing portion further comprises a fourth extending post extending from the third extending post and a fifth extending post substantially perpendicularly extending from the fourth extending post; and the second clipping portion extends from the fifth extending post.

8. The automatic vending machine of claim 7, wherein the third extending post is substantially parallel to the fifth extending post and perpendicular to the fourth extending post.

9. An automatic vending machine comprising:

a cabinet comprising a bottom plate and a rear plate substantially perpendicular to the bottom plate; a mounting portion located on the bottom plate and opposite to the rear plate; the mounting portion defining two securing holes;

a driving member secured to the rear plate;

a helical element secured to the driving member and being moveable when driven by the driving member; and a pressing member extending through the helical element and pressing on the helical element; the pressing member comprising a first securing portion engaged with the driving member and a second securing portion engaged with the mounting portion; the second securing portion comprising a first clipping portion and a second clipping portion; the first clipping portion being defined by two abutting extending posts extending from the pressing member and engaged in one securing hole, and the second clipping portion being located on a free end of the second securing portion and engaged in another securing hole.

10. The automatic vending machine of claim 9, wherein the helical element is rotatable about the pressing member.

11. The automatic vending machine of claim 9, wherein the pressing member comprises a main post located in an interior of the helical element, and the main post is substantially parallel to the bottom plate.

12. The automatic vending machine of claim 11, wherein the first securing portion extends from a main post first end, and the second securing portion extends from a main post second end.

13. The automatic vending machine of claim 12, wherein the driving member comprises a rotating shaft, and the first securing portion is secured to the rotating shaft.

14. The automatic vending machine of claim 12, wherein the mounting portion comprises a first flange substantially parallel to the bottom plate and a second flange substantially perpendicular to the first flange; and the two securing holes being defined in the second flange.

15. The automatic vending machine of claim 11, wherein the second securing portion comprises a first extending post extending from the main post, a second extending post extending from the first extending post, and a third extending post extending from the second extending post; the third extending post abut the second extending post, and the first clipping portion is defined by the second extending post and the third extending post.

16. The automatic vending machine of claim 15, wherein the second securing portion further comprises a fourth extending post extending from the third extending post and a fifth extending post substantially perpendicularly extending from the fourth extending post; the second clipping portion extends from the fifth extending post.

17. The automatic vending machine of claim 16, wherein the third extending post is substantially parallel to the fifth extending post and perpendicular to the fourth extending post.

* * * * *